US008459378B2

(12) United States Patent
Zahradnik et al.

(10) Patent No.: US 8,459,378 B2
(45) Date of Patent: Jun. 11, 2013

(54) HYBRID DRILL BIT

(75) Inventors: Anton F. Zahradnik, Sugar Land, TX (US); Ron D. McCormick, Magnolia, TX (US); Rudolf C. Pessier, The Woodlands, TX (US); Jack T. Oldham, Conroe, TX (US); Michael S. Damschen, Houston, TX (US); Don Q. Nguyen, Houston, TX (US); Matt Meiners, Conroe, TX (US); Karlos B. Cepeda, Fort Worth, TX (US); Mark P. Blackman, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 513 days.

(21) Appl. No.: 12/465,377

(22) Filed: May 13, 2009

(65) Prior Publication Data

US 2010/0288561 A1 Nov. 18, 2010

(51) Int. Cl.
*E21B 10/00* (2006.01)

(52) U.S. Cl.
USPC ..... 175/336

(58) Field of Classification Search
USPC ..... 175/61, 298, 334, 339, 336
See application file for complete search history.

(56) References Cited

U.S. PATENT DOCUMENTS

| | | | |
|---|---|---|---|
| 930,759 | A | 8/1909 | Hughes |
| 1,388,424 | A | 9/1921 | George |
| 1,394,769 | A | 10/1921 | Sorensen |
| 1,519,641 | A | 12/1924 | Thompson |
| 1,816,568 | A | 7/1931 | Carlson |
| 1,821,474 | A | 9/1931 | Mercer |
| 1,874,066 | A | 8/1932 | Scott et al. |
| 1,879,127 | A | 9/1932 | Schlumpf |
| 1,896,243 | A | 2/1933 | Macdonald |
| 1,932,487 | A | 10/1933 | Scott |
| 2,030,722 | A | 2/1936 | Scott |

(Continued)

FOREIGN PATENT DOCUMENTS

| | | |
|---|---|---|
| DE | 13 01 784 | 8/1969 |
| EP | 0225101 | 6/1987 |

(Continued)

OTHER PUBLICATIONS

Beijer, G., International Preliminary Report on Patentability for International Patent Application No. PCT/US2009/042514, The International Bureau of WIPO, dated Nov. 2, 2010.

(Continued)

*Primary Examiner* — Shane Bomar
*Assistant Examiner* — Michael Wills, III
(74) *Attorney, Agent, or Firm* — Sutton McAughan Deaver PLLC

(57) ABSTRACT

A bit body is configured at its upper extent for connection into a drillstring. At least one fixed blade extends downwardly from the bit body, and has a radially outermost gage surface. A plurality of fixed cutting elements is secured to the fixed blade, preferably in a row at its rotationally leading edge. At least one bit leg is secured to the bit body and a rolling cutter is mounted for rotation on the bit leg. At least one stabilizer pad is disposed between the bit leg and the fixed blade, the stabilizer pad extending radially outward to substantially the gage surface. The radially outermost gage surface of each blade can extend axially downward parallel to the bit axis or angled (non-parallel), spirally or helically, relative to the bit axis.

27 Claims, 8 Drawing Sheets

U.S. PATENT DOCUMENTS

| | | | |
|---|---|---|---|
| 2,117,481 | A | 5/1938 | Howard et al. |
| 2,119,618 | A | 6/1938 | Zublin |
| 2,198,849 | A | 4/1940 | Waxier |
| 2,216,894 | A | 10/1940 | Stancliff |
| 2,244,537 | A | 6/1941 | Kammerer |
| 2,297,157 | A | 9/1942 | McClinton |
| 2,320,136 | A | 5/1943 | Kammerer |
| 2,320,137 | A | 5/1943 | Kammerer |
| 2,380,112 | A | 7/1945 | Kinnear |
| RE23,416 | E | 10/1951 | Kinnear |
| 2,719,026 | A | 9/1955 | Boice |
| 2,815,932 | A | 12/1957 | Wolfram |
| 2,994,389 | A | 8/1961 | Bus, Sr. |
| 3,010,708 | A | 11/1961 | Hlinsky et al. |
| 3,050,293 | A | 8/1962 | Hlinsky |
| 3,055,443 | A | 9/1962 | Edwards |
| 3,066,749 | A | 12/1962 | Hildebrandt |
| 3,126,066 | A | 3/1964 | Williams, Jr. |
| 3,126,067 | A | 3/1964 | Schumacher, Jr. |
| 3,174,564 | A | 3/1965 | Morlan |
| 3,239,431 | A | 3/1966 | Raymond |
| 3,250,337 | A | 5/1966 | Demo |
| 3,269,469 | A | 8/1966 | Kelly, Jr. |
| 3,387,673 | A | 6/1968 | Thompson |
| 3,424,258 | A | 1/1969 | Nakayama |
| 3,583,501 | A | 6/1971 | Aalund |
| RE28,625 | E | 11/1975 | Cunningham |
| 4,006,788 | A | 2/1977 | Garner |
| 4,140,189 | A | 2/1979 | Garner |
| 4,190,126 | A | 2/1980 | Kabashima |
| 4,270,812 | A | 6/1981 | Thomas |
| 4,285,409 | A | 8/1981 | Allen |
| 4,293,048 | A | 10/1981 | Kloesel, Jr. |
| 4,320,808 | A | 3/1982 | Garrett |
| 4,343,371 | A | 8/1982 | Baker, III et al. |
| 4,359,112 | A | 11/1982 | Garner et al. |
| 4,369,849 | A | 1/1983 | Parrish |
| 4,386,669 | A | 6/1983 | Evans |
| 4,410,284 | A | 10/1983 | Herrick |
| 4,428,687 | A | 1/1984 | Zahradnik |
| 4,444,281 | A | 4/1984 | Schumacher, Jr. et al. |
| 4,527,637 | A | 7/1985 | Bodine |
| 4,572,306 | A | 2/1986 | Dorosz |
| 4,657,091 | A | 4/1987 | Higdon |
| 4,664,705 | A | 5/1987 | Horton et al. |
| 4,690,228 | A | 9/1987 | Voelz et al. |
| 4,706,765 | A | 11/1987 | Lee et al. |
| 4,726,718 | A | 2/1988 | Meskin et al. |
| 4,727,942 | A | 3/1988 | Galle et al. |
| 4,738,322 | A | 4/1988 | Hall et al. |
| 4,765,205 | A | 8/1988 | Higdon |
| 4,874,047 | A | 10/1989 | Hixon |
| 4,875,532 | A | 10/1989 | Langford, Jr. |
| 4,892,159 | A | 1/1990 | Holster |
| 4,915,181 | A | 4/1990 | Labrosse |
| 4,932,484 | A | 6/1990 | Warren et al. |
| 4,936,398 | A | 6/1990 | Auty et al. |
| 4,943,488 | A | 7/1990 | Sung et al. |
| 4,953,641 | A | 9/1990 | Pessier |
| 4,976,324 | A | 12/1990 | Tibbitts |
| 4,984,643 | A | 1/1991 | Isbell et al. |
| 4,991,671 | A | 2/1991 | Pearce et al. |
| 5,016,718 | A | 5/1991 | Tandberg |
| 5,027,912 | A | 7/1991 | Juergens |
| 5,028,177 | A | 7/1991 | Meskin et al. |
| 5,030,276 | A | 7/1991 | Sung et al. |
| 5,049,164 | A | 9/1991 | Horton et al. |
| 5,116,568 | A | 5/1992 | Sung et al. |
| 5,145,017 | A | 9/1992 | Holster et al. |
| 5,176,212 | A | 1/1993 | Tandberg |
| 5,224,560 | A | 7/1993 | Fernandez |
| 5,238,074 | A | 8/1993 | Tibbitts et al. |
| 5,287,936 | A | 2/1994 | Grimes et al. |
| 5,289,889 | A | 3/1994 | Gearhart et al. |
| 5,337,843 | A | 8/1994 | Torgrimsen et al. |
| 5,346,026 | A | 9/1994 | Pessier et al. |
| 5,351,770 | A | 10/1994 | Cawthorne et al. |
| 5,361,859 | A | 11/1994 | Tibbitts |
| 5,429,200 | A | 7/1995 | Blackman et al. |
| 5,439,068 | A | 8/1995 | Huffstutler et al. |
| 5,452,771 | A | 9/1995 | Blackman et al. |
| 5,467,836 | A | 11/1995 | Grimes et al. |
| 5,472,057 | A | 12/1995 | Winfree |
| 5,472,271 | A | 12/1995 | Bowers et al. |
| 5,513,715 | A | 5/1996 | Dysart |
| 5,518,077 | A | 5/1996 | Blackman et al. |
| 5,547,033 | A | 8/1996 | Campos, Jr. |
| 5,553,681 | A | 9/1996 | Huffstutler et al. |
| 5,558,170 | A | 9/1996 | Thigpen et al. |
| 5,560,440 | A | 10/1996 | Tibbitts |
| 5,570,750 | A | 11/1996 | Williams |
| 5,593,231 | A | 1/1997 | Ippolito |
| 5,606,895 | A | 3/1997 | Huffstutler |
| 5,624,002 | A | 4/1997 | Huffstutler |
| 5,641,029 | A | 6/1997 | Beaton et al. |
| 5,644,956 | A | 7/1997 | Blackman et al. |
| 5,655,612 | A | 8/1997 | Grimes et al. |
| D384,084 | S | 9/1997 | Huffstutler et al. |
| 5,695,018 | A | 12/1997 | Pessier et al. |
| 5,695,019 | A | 12/1997 | Shamburger, Jr. |
| 5,755,297 | A | 5/1998 | Young et al. |
| 5,862,871 | A | 1/1999 | Curlett |
| 5,868,502 | A | 2/1999 | Cariveau et al. |
| 5,873,422 | A | 2/1999 | Hansen et al. |
| 5,941,322 | A | 8/1999 | Stephenson et al. |
| 5,944,125 | A | 8/1999 | Byrd |
| 5,967,246 | A | 10/1999 | Caraway et al. |
| 5,979,576 | A | 11/1999 | Hansen et al. |
| 5,988,303 | A | 11/1999 | Arfele |
| 5,992,542 | A | 11/1999 | Rives |
| 5,996,713 | A | 12/1999 | Pessier et al. |
| 6,092,613 | A | 7/2000 | Caraway et al. |
| 6,095,265 | A | 8/2000 | Alsup |
| 6,109,375 | A | 8/2000 | Tso |
| 6,116,357 | A | 9/2000 | Wagoner et al. |
| 6,173,797 | B1 | 1/2001 | Dykstra et al. |
| 6,220,374 | B1 | 4/2001 | Crawford |
| 6,241,034 | B1 | 6/2001 | Steinke et al. |
| 6,241,036 | B1 | 6/2001 | Lovato et al. |
| 6,250,407 | B1 | 6/2001 | Karlsson |
| 6,260,635 | B1 | 7/2001 | Crawford |
| 6,279,671 | B1 | 8/2001 | Panigrahi et al. |
| 6,283,233 | B1 | 9/2001 | Lamine et al. |
| 6,296,069 | B1 | 10/2001 | Lamine et al. |
| RE37,450 | E | 11/2001 | Deken et al. |
| 6,345,673 | B1 | 2/2002 | Siracki |
| 6,360,831 | B1 | 3/2002 | Akesson et al. |
| 6,367,568 | B2 | 4/2002 | Steinke et al. |
| 6,386,302 | B1 | 5/2002 | Beaton |
| 6,401,844 | B1 | 6/2002 | Doster et al. |
| 6,405,811 | B1 | 6/2002 | Borchardt |
| 6,408,958 | B1 | 6/2002 | Isbell et al. |
| 6,415,687 | B2 | 7/2002 | Saxman |
| 6,439,326 | B1 | 8/2002 | Huang et al. |
| 6,446,739 | B1 | 9/2002 | Richman et al. |
| 6,450,270 | B1 | 9/2002 | Saxton |
| 6,460,635 | B1 | 10/2002 | Kalsi et al. |
| 6,474,424 | B1 | 11/2002 | Saxman |
| 6,510,906 | B1 | 1/2003 | Richert et al. |
| 6,510,909 | B2 | 1/2003 | Portwood et al. |
| 6,527,066 | B1 | 3/2003 | Rives |
| 6,533,051 | B1 | 3/2003 | Singh et al. |
| 6,544,308 | B2 | 4/2003 | Griffin et al. |
| 6,562,462 | B2 | 5/2003 | Griffin et al. |
| 6,568,490 | B1 | 5/2003 | Tso et al. |
| 6,581,700 | B2 | 6/2003 | Curlett et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,661 | B2 | 8/2003 | Baker et al. |
| 6,601,662 | B2 | 8/2003 | Matthias et al. |
| 6,684,967 | B2 | 2/2004 | Mensa-Wilmot et al. |
| 6,729,418 | B2 | 5/2004 | Cariveau et al. |
| 6,739,214 | B2 | 5/2004 | Griffin et al. |
| 6,742,607 | B2 | 6/2004 | Beaton |
| 6,745,858 | B1 | 6/2004 | Estes |
| 6,749,033 | B2 | 6/2004 | Griffin et al. |

| | | | | |
|---|---|---|---|---|
| 6,797,326 | B2 | 9/2004 | Griffin et al. | |
| 6,823,951 | B2 | 11/2004 | Yong et al. | |
| 6,843,333 | B2 | 1/2005 | Richert et al. | |
| 6,861,098 | B2 | 3/2005 | Griffin et al. | |
| 6,861,137 | B2 | 3/2005 | Griffin et al. | |
| 6,878,447 | B2 | 4/2005 | Griffin et al. | |
| 6,883,623 | B2 | 4/2005 | McCormick et al. | |
| 6,902,014 | B1 | 6/2005 | Estes | |
| 6,986,395 | B2 | 1/2006 | Chen | |
| 6,988,569 | B2 | 1/2006 | Lockstedt et al. | |
| 7,096,978 | B2 | 8/2006 | Dykstra et al. | |
| 7,111,694 | B2 | 9/2006 | Beaton | |
| 7,137,460 | B2 | 11/2006 | Slaughter, Jr. et al. | |
| 7,152,702 | B1 | 12/2006 | Bhome et al. | |
| 7,197,806 | B2 | 4/2007 | Boudreaux et al. | |
| 7,198,119 | B1 | 4/2007 | Hall et al. | |
| 7,234,550 | B2 | 6/2007 | Azar et al. | |
| 7,270,196 | B2 | 9/2007 | Hall | |
| 7,281,592 | B2 | 10/2007 | Runia et al. | |
| 7,320,375 | B2 | 1/2008 | Singh | |
| 7,350,568 | B2 | 4/2008 | Mandal et al. | |
| 7,350,601 | B2 | 4/2008 | Belnap et al. | |
| 7,360,612 | B2 | 4/2008 | Chen et al. | |
| 7,377,341 | B2 | 5/2008 | Middlemiss et al. | |
| 7,387,177 | B2 | 6/2008 | Zahradnik et al. | |
| 7,392,862 | B2 | 7/2008 | Zahradnik et al. | |
| 7,398,837 | B2 | 7/2008 | Hall et al. | |
| 7,416,036 | B2 | 8/2008 | Forstner et al. | |
| 7,435,478 | B2 | 10/2008 | Keshavan | |
| 7,462,003 | B2 | 12/2008 | Middlemiss | |
| 7,473,287 | B2 | 1/2009 | Belnap et al. | |
| 7,493,973 | B2 | 2/2009 | Keshavan et al. | |
| 7,517,589 | B2 | 4/2009 | Eyre | |
| 7,533,740 | B2 | 5/2009 | Zhang et al. | |
| 7,568,534 | B2 | 8/2009 | Griffin et al. | |
| 7,621,346 | B1 | 11/2009 | Trinh et al. | |
| 7,621,348 | B2 | 11/2009 | Hoffmaster et al. | |
| 7,703,556 | B2 | 4/2010 | Smith et al. | |
| 7,703,557 | B2 | 4/2010 | Durairajan et al. | |
| 7,819,208 | B2 | 10/2010 | Pessier et al. | |
| 7,836,975 | B2 | 11/2010 | Chen et al. | |
| 7,845,435 | B2 | 12/2010 | Zahradnik et al. | |
| 7,845,437 | B2 | 12/2010 | Bielawa et al. | |
| 7,847,437 | B2 | 12/2010 | Chakrabarti et al. | |
| 2001/0000885 | A1* | 5/2001 | Beuershausen et al. | 175/408 |
| 2002/0092684 | A1* | 7/2002 | Singh et al. | 175/339 |
| 2002/0100618 | A1* | 8/2002 | Watson et al. | 175/73 |
| 2002/0108785 | A1 | 8/2002 | Slaughter, Jr. et al. | |
| 2004/0099448 | A1 | 5/2004 | Fielder et al. | |
| 2004/0238224 | A1 | 12/2004 | Runia | |
| 2005/0087370 | A1 | 4/2005 | Ledgerwood, III et al. | |
| 2005/0103533 | A1 | 5/2005 | Sherwood et al. | |
| 2005/0178587 | A1 | 8/2005 | Witman, IV et al. | |
| 2005/0183892 | A1 | 8/2005 | Oldham et al. | |
| 2005/0263328 | A1 | 12/2005 | Middlemiss | |
| 2005/0273301 | A1 | 12/2005 | Huang | |
| 2006/0032674 | A1 | 2/2006 | Chen et al. | |
| 2006/0032677 | A1 | 2/2006 | Azar et al. | |
| 2006/0162969 | A1 | 7/2006 | Belnap et al. | |
| 2006/0196699 | A1 | 9/2006 | Estes et al. | |
| 2006/0254830 | A1 | 11/2006 | Radtke | |
| 2006/0266558 | A1 | 11/2006 | Middlemiss et al. | |
| 2006/0266559 | A1 | 11/2006 | Keshavan et al. | |
| 2006/0278442 | A1 | 12/2006 | Kristensen | |
| 2006/0283640 | A1 | 12/2006 | Estes et al. | |
| 2007/0029114 | A1 | 2/2007 | Middlemiss | |
| 2007/0062736 | A1 | 3/2007 | Cariveau et al. | |
| 2007/0079994 | A1 | 4/2007 | Middlemiss | |
| 2007/0187155 | A1 | 8/2007 | Middlemiss | |
| 2007/0221417 | A1 | 9/2007 | Hall et al. | |
| 2008/0066970 | A1 | 3/2008 | Zahradnik et al. | |
| 2008/0264695 | A1* | 10/2008 | Zahradnik et al. | 175/336 |
| 2008/0296068 | A1 | 12/2008 | Zahradnik et al. | |
| 2009/0114454 | A1 | 5/2009 | Belnap et al. | |
| 2009/0120693 | A1 | 5/2009 | McClain et al. | |
| 2009/0126998 | A1 | 5/2009 | Zahradnik et al. | |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0183925 | A1 | 7/2009 | Zhang et al. | |
| 2009/0272582 | A1 | 11/2009 | McCormick et al. | |
| 2010/0224417 | A1 | 9/2010 | Zahradnik et al. | |
| 2010/0276205 | A1 | 11/2010 | Oxford et al. | |
| 2010/0288561 | A1 | 11/2010 | Zahradnik et al. | |
| 2010/0320001 | A1 | 12/2010 | Kulkarni | |
| 2011/0024197 | A1 | 2/2011 | Centala et al. | |
| 2011/0079440 | A1 | 4/2011 | Buske et al. | |
| 2011/0079441 | A1 | 4/2011 | Buske et al. | |
| 2011/0079442 | A1 | 4/2011 | Buske et al. | |
| 2011/0079443 | A1 | 4/2011 | Buske et al. | |
| 2011/0162893 | A1 | 7/2011 | Zhang | |

FOREIGN PATENT DOCUMENTS

| | | |
|---|---|---|
| EP | 0157278 | 11/1989 |
| EP | 0391683 | 1/1996 |
| EP | 0874128 | 10/1998 |
| EP | 2089187 | 8/2009 |
| GB | 2183694 | 6/1987 |
| JP | 2000080878 | 3/2000 |
| JP | 2001159289 | 6/2001 |
| SU | 1 331 988 | 8/1987 |
| WO | 8502223 | 5/1985 |
| WO | 2008124572 | 10/2008 |

OTHER PUBLICATIONS

Jung Hye Lee, International Search Report for International Patent Application No. PCT/US2009/042514, Korean Intellectual Property Office, dated Nov. 27, 2009.

Jung Hye Lee, Written Opinion for International Patent Application No. PCT/US2009/042514, Korean Intellectual Property Office, dated Nov. 27, 2009.

Kang, K.H., International Search Report for International Patent Application No. PCT/US2010/033513, Korean Intellectual Property Office, dated Jan. 10, 2011.

Kang, K.H., Written Opinion for International Patent Application No. PCT/US2010/033513, Korean Intellectual Property Office, dated Jan. 10, 2011.

Kang, M.S., International Search Report for International Patent Application No. PCT/US2010/032511, Korean Intellectual Property Office, dated Jan. 17, 2011.

Kang, M.S., Written Opinion for International Patent Application No. PCT/US2010/032511, Korean Intellectual Property Office, dated Jan. 17, 2011.

Choi, J.S., International Search Report for International Patent Application No. PCT/US2010/039100, Korean Intellectual Property Office, dated Jan. 25, 2011.

Choi, J.S., Written Opinion for International Patent Application No. PCT/US2010/039100, Korean Intellectual Property Office, dated Jan. 25, 2011.

Baharlou, S., International Preliminary Report on Patentability, The International Bureau of WIPO, dated Jan. 25, 2011.

Sung Joon Lee, International Search Report for International Patent Application No. PCT/US2009/050672, Korean Intellectual Property Office, dated Mar. 3, 2010.

Sung Joon Lee, Written Opinion for International Patent Application No. PCT/US2009/050672, Korean Intellectual Property Office, dated Mar. 3, 2010.

Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.

S.H. Kim, International Search Report for International Patent Application No. PCT/US2009/067969, Korean Intellectual Property Office, dated May 25, 2010.

S.H. Kim, Written Opinion for International Patent Application No. PCT/US2009/067969, Korean Intellectual Property Office, dated May 25, 2010.

International Search Report for corresponding International patent application No. PCT/US2008/083532.

Written Opinion for corresponding International patent application No. PCT/US2008/083532.

Sheppard, N. and Dolly, B. "Rock Drilling—Hybrid Bit Success for Syndax3 Pins." Industrial Diamond Review, Jun. 1993, pp. 309-311.

Tomlinson, P. and Clark, I. "Rock Drilling—Syndax3 Pins—New Concepts in PCD Drilling." Industrial Diamond Review, Mar. 1992, pp. 109-114.
Williams, J. and Thompson, A. "An Analysis of the Performance of PDC Hybrid Drill Bits." SPE/IADC 16117, SPE/IADC Drilling Conference, Mar. 1987, pp. 585-594.
Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.
Smith Services. "Hole Opener—Model 6980 Hole Opener." [retrieved from the Internet on May 7, 2008 using <URL: http://www.siismithservices.com/b_products/product_page.asp?ID=589>].
Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].
Ersoy, A. and Waller, M. "Wear characteristics of PDC pin and hybrid core bits in rock drilling." Wear 188, Elsevier Science S.A., Mar. 1995, pp. 150-165.
R. Buske, C. Rickabaugh, J. Bradford, H. Lukasewich and J. Overstreet. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.
Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.
B. George, E. Grayson, R. Lays, F. Felderhoff, M. Doster and M. Holmes. "Significant Cost Savings Achieved Through the Use of PDC Bits in Compressed Air/Foam Applications." Society of Petroleum Engineers—SPE 116118, 2008 SPE Annual Technical Conference and Exhibition, Denver, Colorado, Sep. 21-24, 2008.
Georgescu, M., International Search Report for International Patent Application No. PCT/US2010/051019, dated Jun. 6, 2011, European Patent Office.
Georgescu, M., Written Opinion for International Patent Application No. PCT/US2010/051019, dated Jun. 6, 2011, European Patent Office.
Georgescu, M., International Search Report for International Patent Application No. PCT/US2010/051020, dated Jun. 1, 2011, European Patent Office.
Georgescu, M., Written Opinion for International Patent Application No. PCT/US2010/051020, dated Jun. 1, 2011, European Patent Office.
Georgescu, M., International Search Report for International Patent Application No. PCT/US2010/051017, dated Jun. 8, 2011, European Patent Office.
Georgescu, M., Written Opinion for International Patent Application No. PCT/US2010/051017, dated Jun. 8, 2011, European Patent Office.
Georgescu, M., International Search Report for International Patent Application No. PCT/US2010/051014, dated Jun. 9, 2011, European Patent Office.
Georgescu, M., Written Opinion for International Patent Application No. PCT/US2010/051014, dated Jun. 9, 2011, European Patent Office.
Georgescu, M., International Search Report for International Patent Application No. PCT/US2010/050631, dated Jun. 10, 2011, European Patent Office.
Georgescu, M., Written Opinion for International Patent Application No. PCT/US2010/050631, dated Jun. 10, 2011, European Patent Office.
Becamel, P., International Preliminary Report on Patentability, dated Jan. 5, 2012, the International Bureau of WIPO, Switzerland.

* cited by examiner

HYBRID DRILL BIT

BACKGROUND OF THE INVENTION

1. Technical Field

The present invention relates in general to earth-boring drill bits and, in particular, to a bit having a combination of rolling and fixed cutters and cutting elements and a method of drilling with same.

2. Description of the Related Art

The success of rotary drilling enabled the discovery of deep oil and gas reservoirs and production of enormous quantities of oil. The rotary rock bit was an important invention that made the success of rotary drilling possible. Only soft earthen formations could be penetrated commercially with the earlier drag bit and cable tool, but the two-cone rock bit, invented by Howard R. Hughes, U.S. Pat. No. 930,759, drilled the caprock at the Spindletop field, near Beaumont, Tex. with relative ease. That venerable invention, within the first decade of the last century, could drill a scant fraction of the depth and speed of the modern rotary rock bit. The original Hughes bit drilled for hours, the modern bit drills for days. Modern bits sometimes drill for thousands of feet instead of merely a few feet. Many advances have contributed to the impressive improvements in rotary rock bits.

In drilling boreholes in earthen formations using rolling-cone or rolling-cutter bits, rock bits having one, two, or three rolling cutters rotatably mounted thereon are employed. The bit is secured to the lower end of a drillstring that is rotated from the surface or by a downhole motor or turbine. The cutters mounted on the bit roll and slide upon the bottom of the borehole as the drillstring is rotated, thereby engaging and disintegrating the formation material to be removed. The rolling cutters are provided with cutting elements or teeth that are forced to penetrate and gouge the bottom of the borehole by weight from the drillstring. The cuttings from the bottom and sides of the borehole are washed away by drilling fluid that is pumped down from the surface through the hollow, rotating drillstring, and are carried in suspension in the drilling fluid to the surface.

Rolling cutter bits dominated petroleum drilling for the greater part of the $20^{th}$ century. With improvements in synthetic diamond technology that occurred in the 1970s and 1980s, the fixed-cutter, or "drag" bit, became popular again in the latter part of the $20^{th}$ century. Modern fixed-cutter bits are often referred to as "diamond" or "PDC" (polycrystalline diamond compact) bits and are far removed from the original fixed-cutter bits of the $19^{th}$ and early $20^{th}$ centuries. Diamond or PDC bits carry cutting elements comprising polycrystalline diamond compact layers or "tables" formed on and bonded to a supporting substrate, conventionally of cemented tungsten carbide, the cutting elements being arranged in selected locations on blades or other structures on the bit body with the diamond tables facing generally in the direction of bit rotation. Diamond bits have an advantage over rolling-cutter bits in that they generally have no moving parts. The drilling mechanics and dynamics of diamond bits are different from those of rolling-cutter bits precisely because they have no moving parts. During drilling operation, diamond bits are used in a manner similar to that for rolling cutter bits, the diamond bits also being rotated against a formation being drilled under applied weight on bit to remove formation material. Engagement between the diamond cutting elements and the borehole bottom and sides shears or scrapes material from the formation, instead of using a crushing action as is employed by rolling-cutter bits. Rolling-cutter and diamond bits each have particular applications for which they are more suitable than the other; neither type of bit is likely to completely supplant the other in the foreseeable future.

Some earth-boring bits use a combination of one or more rolling cutters and one or more fixed blades. Some of these combination-type drill bits are referred to as hybrid bits. Previous designs of hybrid bits, such as is described in U.S. Pat. No. 4,343,371 to Baker, III, have provided for the rolling cutters to do most of the formation cutting, especially in the center of the hole or bit. Other types of combination bits are known as "core bits," such as U.S. Pat. No. 4,006,788 to Garner. Core bits typically have truncated rolling cutters that do not extend to the center of the bit and are designed to remove a core sample of formation by drilling down, but around, a solid cylinder of the formation to be removed from the borehole generally intact.

Another type of hybrid bit is described in U.S. Pat. No. 5,695,019 to Shamburger, Jr., wherein the rolling cutters extend almost entirely to the center. Fixed cutter inserts 50 (FIGS. 2 and 3) are located in the dome area or "crotch" of the bit to complete the removal of the drilled formation. Still another type of hybrid bit is sometimes referred to as a "hole opener," an example of which is described in U.S. Pat. No. 6,527,066. A hole opener has a fixed threaded protuberance that extends axially beyond the rolling cutters for the attachment of a pilot bit that can be a rolling cutter or fixed cutter bit. In these latter two cases the center is cut with fixed cutter elements but the fixed cutter elements do not form a continuous, uninterrupted cutting profile from the center to the perimeter of the bit.

A concern with all bits is stable running. Fixed- and rolling-cutter bits have different dynamic behavior during drilling operation and therefore different bit characteristics contribute to stable or unstable running. In a stable configuration, a bit drills generally about its geometric center, which corresponds with the axial center of the borehole, and lateral or other dynamic loadings of the bit and its cutting elements are avoided. Stabilizer pads can be provided to increase the area of contact between the bit body and the sidewall of the borehole to contribute to stable running. Such stabilizer pads tend to be effective in fixed-cutter bits, but can actually contribute to unstable running in rolling-cutter bits because the contact point between the pad and the sidewall of the borehole becomes an instant center of rotation of the bit, causing the bit to run off-center. Commonly assigned U.S. Pat. No. 4,953,641 to Pessier et al. and U.S. Pat. No. 5,996,731 to Pessier et al. disclose stabilizer pad arrangements for rolling-cutter bits that avoid the disadvantages of stabilizer pads. None of the foregoing "hybrid" bit disclosures address issues of stable running.

Although each of these bits is workable for certain limited applications, an improved hybrid earth-boring bit with enhanced stabilization to improve drilling performance would be desirable.

SUMMARY OF THE INVENTION

Embodiments of the present invention comprise an improved earth-boring bit of the hybrid variety. One embodiment comprises a bit body configured at its upper extent for connection into a drillstring. At least one fixed blade extends downwardly from the bit body, and has a radially outermost gage surface. A plurality of fixed cutting elements is secured to the fixed blade, preferably in a row at its rotationally leading edge and the radially outermost cutting elements on the radially outermost surface of the fixed blade define the bit and borehole diameter. At least one bit leg is secured to the bit body and a rolling cutter is mounted for rotation on the bit leg.

At least one stabilizer pad is disposed between the bit leg and the fixed blade, the stabilizer pad extending radially outward to substantially the gage surface.

According to an embodiment of the present invention, the stabilizer pad is formed integrally with the fixed blade and extends toward the bit leg in a rotationally leading direction According to an embodiment of the present invention, a portion of the bit leg extends radially outward to substantially the gage surface and the stabilizer pad, the gage surface of each fixed blade, and the portion of the bit leg extending to the gage surface together describe a segment of the circumference of the borehole that equals or exceeds 180 degrees.

According to an embodiment of the present invention, each stabilizer pad has an equal area.

According to an embodiment of the present invention, there may be a plurality of fixed blades and bit legs and associated rolling cutters.

According to an embodiment of the present invention, the outermost radial surfaces of the bit legs and fixed blades are joined or formed integrally to define a stabilizer pad.

Other features and advantages of embodiments of the earth-boring bit according to the present invention will become apparent with reference to the drawings and the detailed description of the invention.

BRIEF DESCRIPTION OF THE DRAWINGS

So that the manner in which the features and advantages of the present invention, which will become apparent, are attained and can be understood in more detail, more particular description of embodiments of the invention as briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
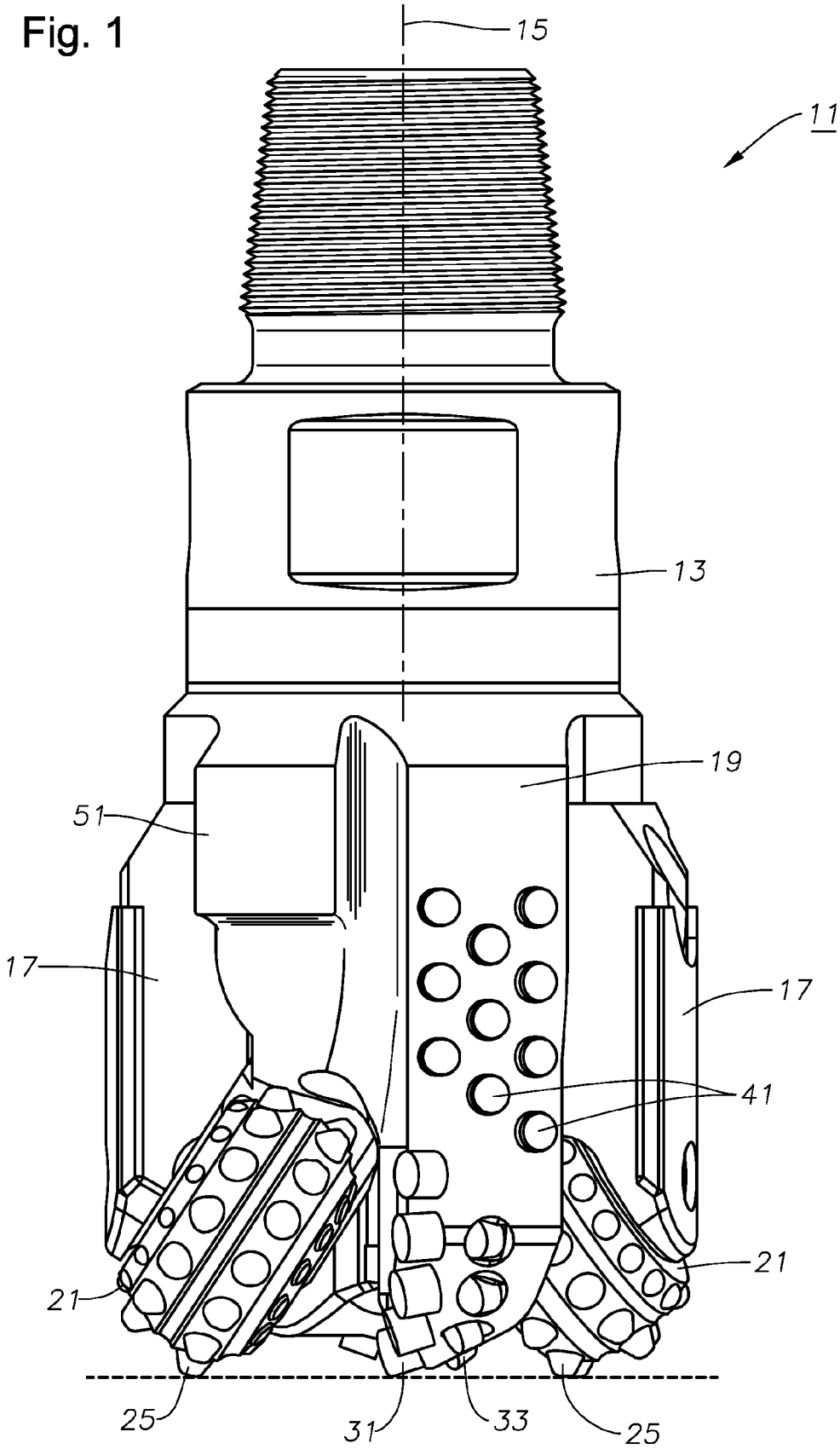
FIG. 1 is a side elevation view of an embodiment of the hybrid earth-boring bit constructed in accordance with the present invention.
Figure 2:
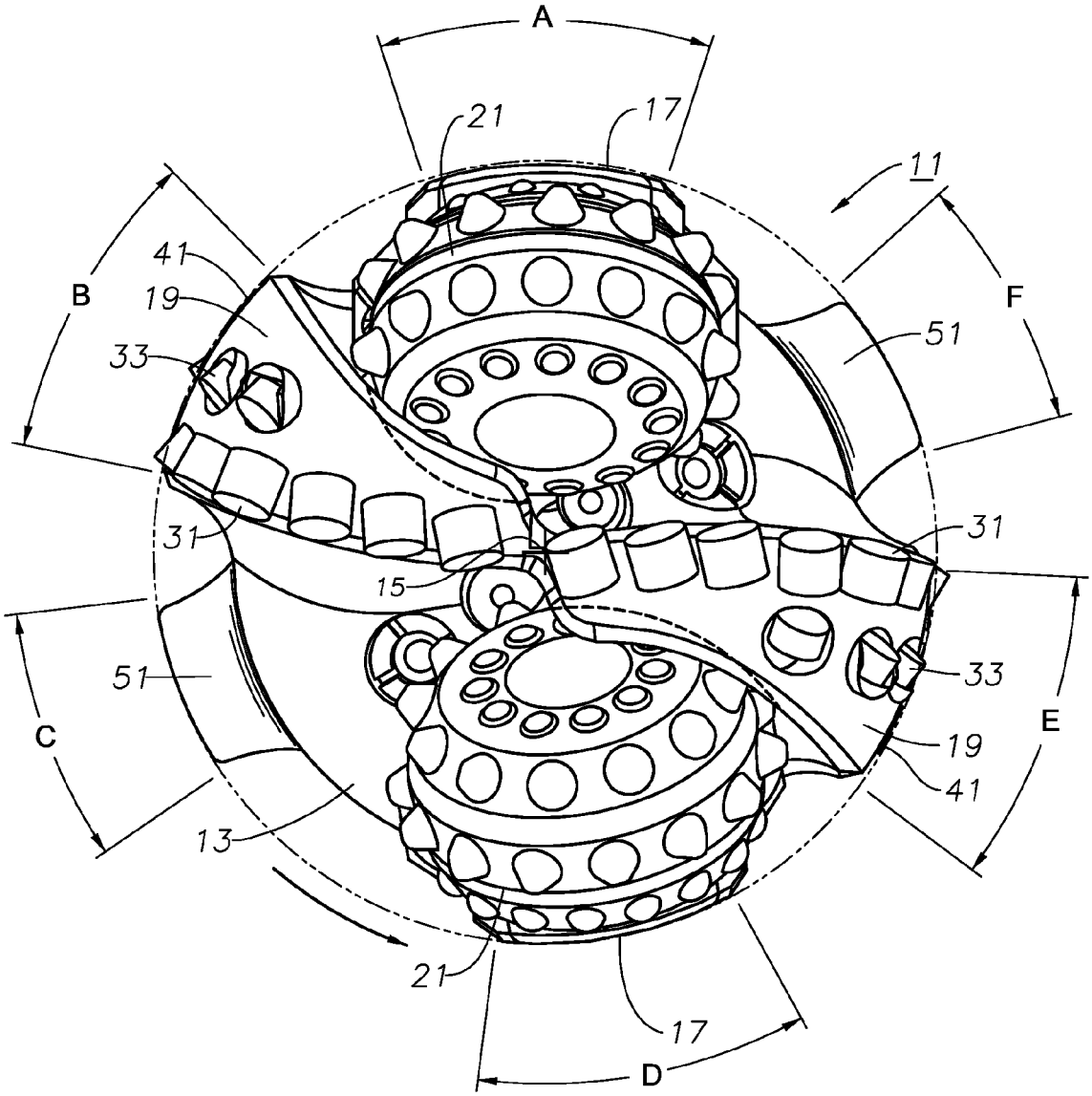
FIG. 2 is a bottom plan view of the embodiment of the hybrid earth-boring bit of FIG. 1 constructed in accordance with the present invention.

Referring to FIGS. 1 through 8, and particularly to FIGS. 1 and 2, an earth-boring bit 11 according to an illustrative embodiment of the present invention is disclosed. Bit 11 comprises a bit body 13 having a central longitudinal axis 15 that defines an axial center of the bit body 13. In the illustrated embodiment, the bit body 13 is steel, but could also be formed of matrix material with steel reinforcements, or of a sintered carbide material. Bit body 13 includes a shank at the upper or trailing end thereof threaded or otherwise configured for attachment to a hollow drillstring (not shown), which rotates bit 11 and provides pressurized drilling fluid to the bit and the formation being drilled.

At least one (two are shown) bit leg 17 extends downwardly from the bit body 13 in the axial direction. The bit body 13 also has a plurality (e.g., also two shown) of fixed blades 19 that extend downwardly in the axial direction. The number of bit legs 17 and fixed blades 19 is at least one but may be more than two. In the illustrated embodiment, bit legs 17 (and the associated rolling cutters) are not directly opposite one another (are about 191 degrees apart measured in the direction of rotation of bit 11), nor are fixed blades 19 (which are about 169 degrees apart measured in the direction of rotation of bit 11). Other spacings and distributions of legs 17 and blades 19 may be appropriate.

A rolling cutter 21 is mounted on a sealed journal bearing that is part of each bit leg 17. According to the illustrated embodiment, the rotational axis of each rolling cutter 21 intersects the axial center 15 of the bit. Unsealed journal or sealed or unsealed rolling-element bearings may be employed in addition to the sealed journal bearing. The radially outermost surface of each rolling cutter 21 (typically called the gage cutter surface in conventional rolling cutter bits), is spaced slightly radially inward from the outermost gage surface of bit body 13, but the radially outermost surfaces of the bit legs may extend to full gage diameter (typically within 0.050-0.250 inch of full gage diameter), so that the bit legs contact the sidewall of the borehole during drilling operation to assist in stabilizing the bit during drilling operation. The radially outermost surface of each bit leg 17 may also be recessed from the full gage diameter, in which case less or no stabilization is effected. In the illustrated embodiment, rolling cutters 21 have no skew or angle and no offset, so that the axis of rotation of each rolling cutter 21 intersects the axial center (central axis) 15 of the bit body 13. Alternatively, the rolling cutters 21 may be provided with skew angle and (or) offset to induce sliding of the rolling cutters 21 as they roll over the borehole bottom.

At least one (a plurality is illustrated) rolling-cutter cutting elements 25 are arranged on the rolling cutters 21 in generally circumferential rows. Rolling-cutter cutting elements 25 need not be arranged in rows, but instead could be "randomly" placed on each rolling cutter 21. Moreover, the rolling-cutter cutting elements may take the form of one or more discs or "kerf-rings," which would also fall within the meaning of the term rolling-cutter cutting elements.

Tungsten carbide inserts 25, secured by interference fit into bores in the rolling cutter 21 are shown, but a milled- or steel-tooth cutter having hardfaced cutting elements (25) integrally formed with and protruding from the rolling cutter could be used in certain applications and the term "rolling-cutter cutting elements" as used herein encompasses such teeth. The inserts or cutting elements may be chisel-shaped as shown, conical, round, or ovoid, or other shapes and combinations of shapes depending upon the application. Rolling-cutter cutting elements 25 may also be formed of, or coated with, super-abrasive or super-hard materials such as polycrystalline diamond, cubic boron nitride, and the like.

In addition, a plurality of fixed-blade cutting elements 31 are arranged in a row and secured to each of the fixed blades 19 at the rotationally leading edges thereof (leading being defined in the direction of rotation of bit 11). Each of the fixed-blade cutting elements 31 comprises a polycrystalline diamond layer or table on a rotationally leading face of a supporting tungsten carbide substrate, the diamond layer or table providing a cutting face having a cutting edge at a periphery thereof for engaging the formation. The radially outermost cutting elements 31 on the radially outermost surface of each of the fixed blades 19 define the bit and borehole diameter (shown in phantom in FIGS. 2, 4 and 6) drilled by bit 11. Each blade may also be provided with back-up cutters 33.

In addition to fixed-blade cutting elements 31 (and backup cutters 33) including polycrystalline diamond tables mounted on tungsten carbide substrates, such term as used herein encompasses thermally stable polycrystalline diamond (TSP) wafers or tables mounted on tungsten carbide substrates, and other, similar super-abrasive or super-hard materials such as cubic boron nitride and diamond-like carbon. Fixed-blade cutting elements 31 may be brazed or otherwise secured in recesses or "pockets" on each blade 19 so that their peripheral or cutting edges on cutting faces are presented to the formation.

The upper, radially outermost (gage) surface of each fixed blade 19 extends to full gage diameter (typically within 0.050-0.250 inch of full gage diameter) and serves as a stabilizer. This surface may be provided with a plurality of flat-topped inserts 41 that may or may not be configured with relatively sharp cutting edges. Without sharp cutting edges, inserts 41 serve to resist wear of the upper portion of each fixed blade. With sharp cutting edges, as disclosed in commonly assigned U.S. Pat. Nos. 5,287,936, 5,346,026, 5,467,836, 5,655,612, and 6,050,354, inserts 41 assist with reaming and maintaining the gage diameter of the borehole. Inserts 41 may be formed of tungsten carbide or other hard metal, alone or in combination with polycrystalline or synthetic or natural diamond or other super-abrasive material. Super-abrasive materials are preferred, but not necessary, if inserts 41 are provided with sharp cutting edges for active cutting of the sidewall of the borehole. Inserts may be brazed or interference fit, or otherwise conventionally secured to fixed blades 19 (and may also be provided on the radially outermost surfaces of bit legs 17).

According to the illustrated embodiment, at least a portion of at least one of the fixed cutting elements 31 is located near or at the axial center 15 of the bit body 13 and thus is positioned to remove formation material at the axial center of the borehole (typically, the axial center of the bit will generally coincide with the center of the borehole being drilled, with some minimal variation due to lateral bit movement during drilling). In a 7⅞ inch bit as illustrated, at least one of the fixed cutting elements 31 has its laterally innermost edge tangent or in close proximity to the axial center 15 of the bit 11. While this center-cutting feature is a preferred embodiment, the teachings of the present invention are equally applicable to hybrid bits lacking this feature.

Figure 3:
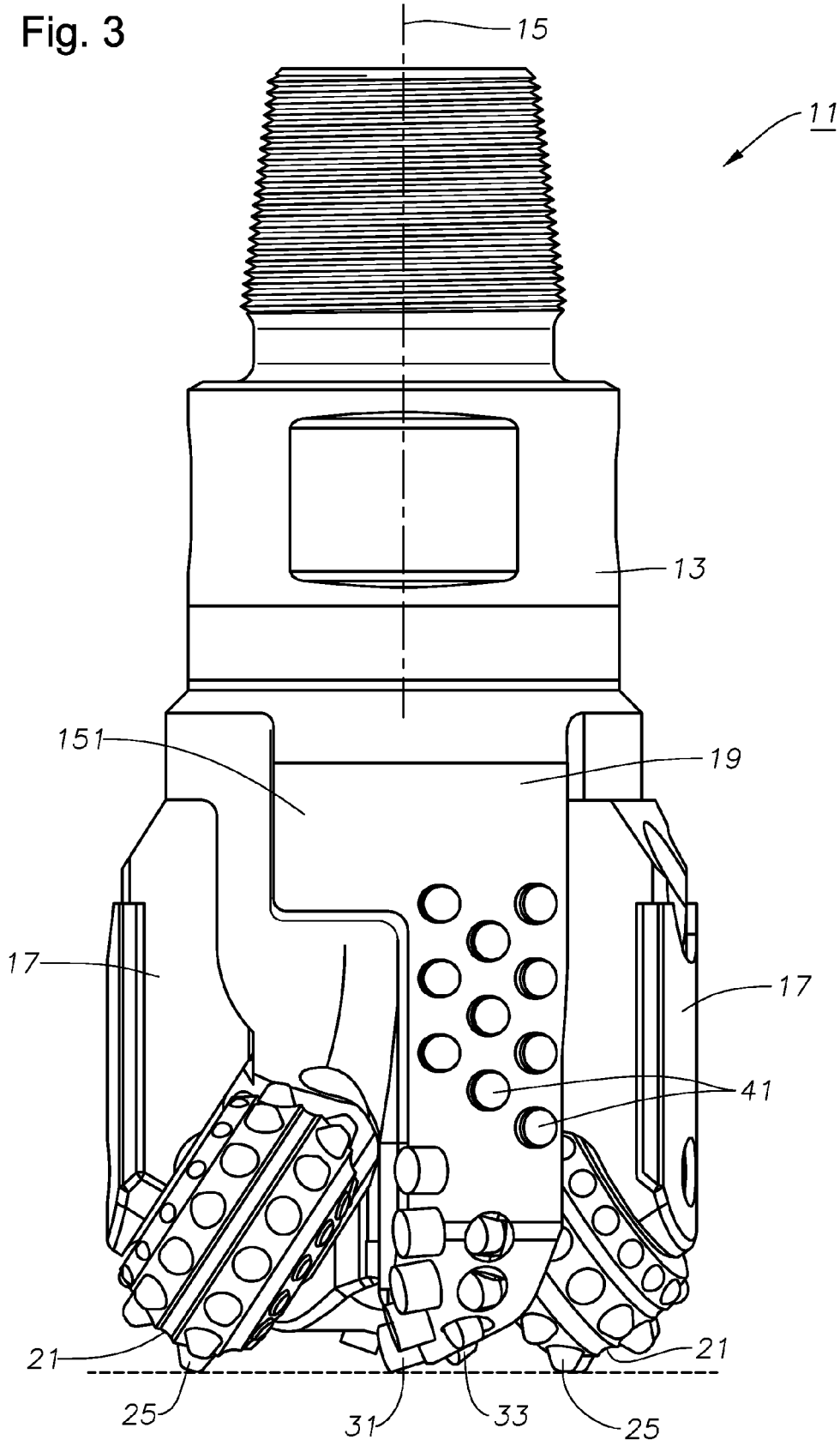
FIG. 3 is a side elevation view of an embodiment of the hybrid earth-boring bit constructed in accordance with the present invention.
Figure 4:
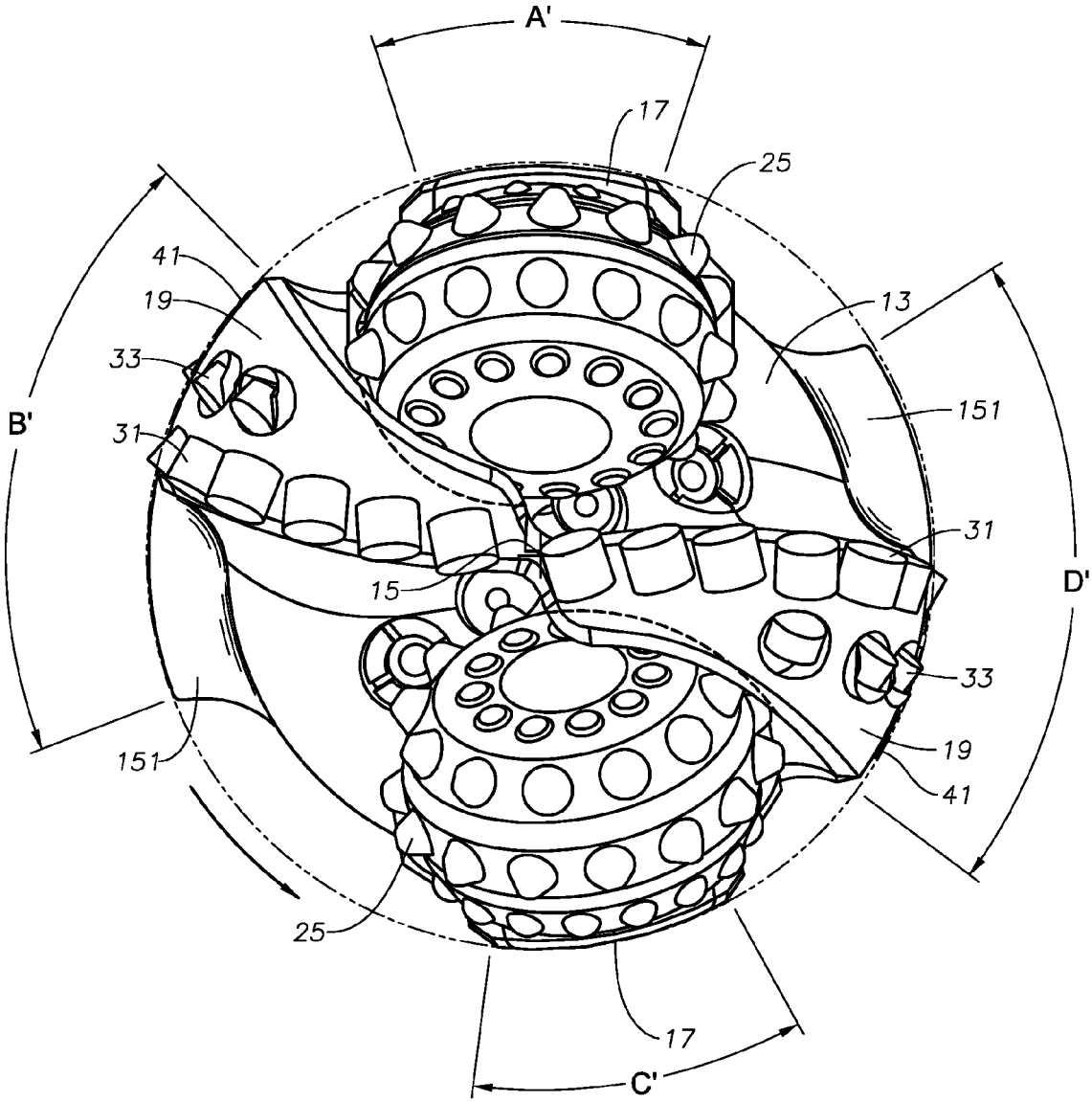
FIG. 4 is a bottom plan view of the embodiment of the hybrid earth-boring bit of FIG. 3 constructed in accordance with the present invention.

A stabilizer pad 51, 151 is located on the bit body 13 between each bit leg 17 and fixed blade 19, preferably rotationally leading or ahead of each fixed blade 19 and midway between blade 19 and bit leg 17. Each stabilizer pad extends radially outwardly to the full gage diameter (again, typically within 0.050-0.250 inch) of bit 11 to ensure that each pad 51, 151 remains in contact with the sidewall of the borehole during drilling operation to effect stabilization of the bit. As shown in FIGS. 1 and 2, stabilizer pads 51 are discrete and separate from fixed blade 19 and bit leg 17. Alternatively, as shown in FIGS. 3 and 4, stabilizer pads 151 are integral with and extend in a rotationally leading direction from each fixed blade 19. The term "integral" is intended to encompass any manufacturing process resulting in the structure shown in FIGS. 3 and 4. The pads could also be multiple discrete pads between bit legs 17 and blades 19.

Each pad 51, 151 has a borehole sidewall engaging surface formed as described in commonly assigned U.S. Pat. No. 5,996,713 to Pessier, et al. Additionally, the area (exposed to the sidewall of the borehole being drilled) of each pad 51, 151 should be equal, so that no single pad has a greater area of contact than any other pad and the pads are therefore less likely to become an instant center of rotation of the bit 11.

Figure 5:
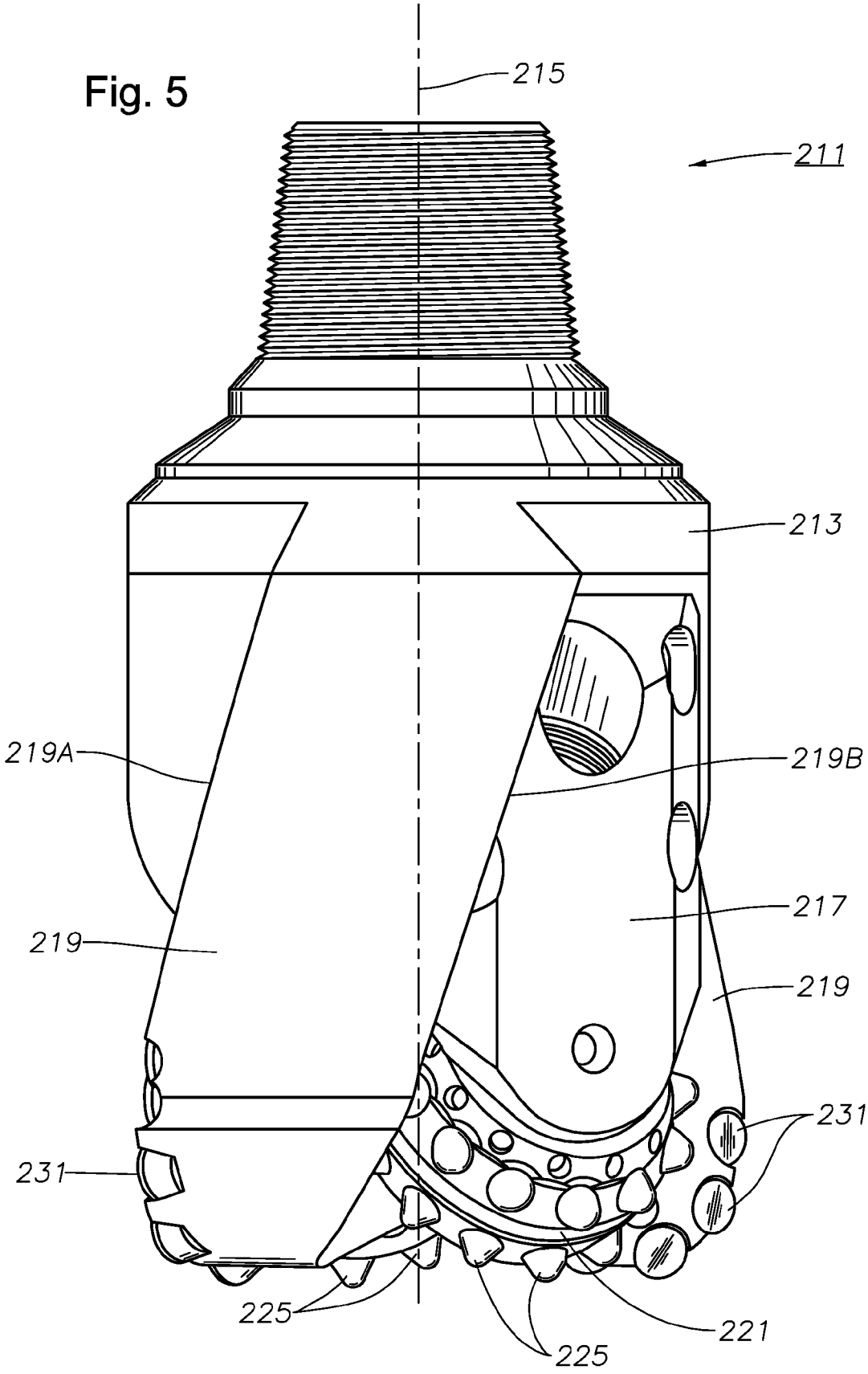
FIG. 5 is a side elevation view of an embodiment of the hybrid earth-boring bit constructed in accordance with the present invention.
Figure 6:
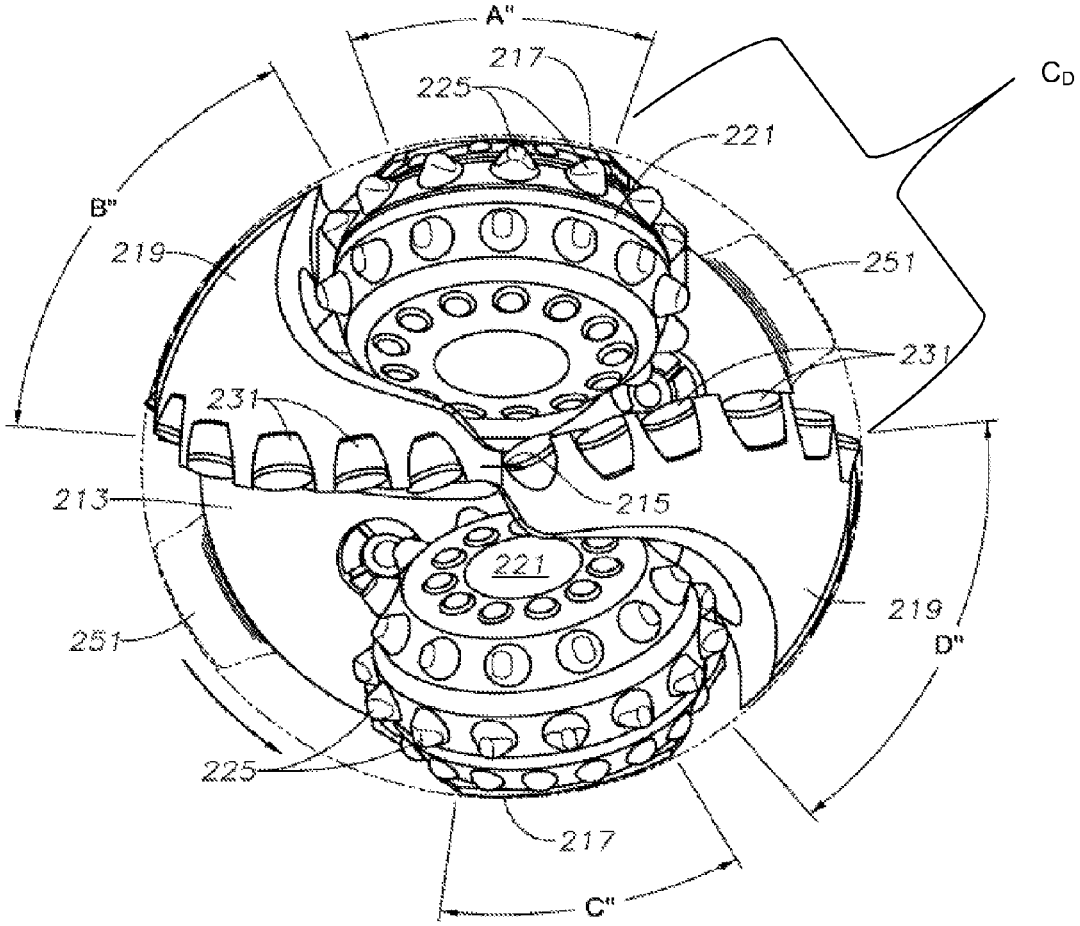
FIG. 6 is a bottom plan view of the embodiment of the hybrid earth-boring bit of FIG. 5 constructed in accordance with the present invention.

FIGS. 5 and 6 illustrate another embodiment of the invention that is generally similar to the embodiments of FIGS. 1 through 4 (similar structures are numbered similarly, e.g., bit legs 17, 217; blades 19, 219, etc.), except the gage or radially outermost surface of each fixed blade 219 is made wider than typical and, rather than extending axially downward and parallel to the longitudinal axis 215, extends helically or spirally or linearly at an angle relative to (not or non-parallel to) the longitudinal axis 215, i.e., at an angle other than zero. Both the leading 219A and trailing edges 219B of the gage surface of each blade 219 extend downwardly at a selected angle (approximately 20 degrees is illustrated in FIG. 5). Alternatively, one of the leading or trailing edges 219A, 219B can extend at an angle or non-parallel to the longitudinal axis, while the other is parallel.

As shown in FIG. 6, each blade then operates as a stabilizer pad that describes a much larger segment or angular portion (labeled B" and D") than a "straight" blade that extends downward parallel to the longitudinal axis 215 of bit 211. Such a configuration is especially useful when there are relatively few blades 219 and provides stabilization in the area rotationally trailing each blade 219, which can be useful for preventing backward whirl. Additionally, the spiral or angled blade configuration creates large-area stabilizer pads without blocking or impeding the return flow to the same extent as a discrete stabilizer pad of the same area, allowing freer return of drilling fluid and cuttings through the junk slots to the annulus. Nevertheless, as can be seen in FIG. 6, the angled or spiral blades 219 leave a significant amount of "chordal drop" present in the region leading each blade 219. Chordal drop ($C_D$) is measured by drawing a chord between the leading edge of blade 219 and trailing edge of bit leg 217 (it is a chord of the borehole diameter). The maximum distance between the chord and the gage or borehole diameter, measured perpendicular to the chord, is the chordal drop $C_D$. It is desirable that chordal drop be minimized and also equal between each bit leg 217 and blade 219. In the case of the spiral or angled blade embodiment, it may be desirable to provide a leading stabilization pad 251 (shown in phantom in FIG. 6) between each blade 219 and bit leg 217 to avoid excessive chordal drop. Such a stabilization pad preferably is separate from the blade 219, but may also be formed integrally, as described above in connection with FIGS. 3 and 4.

Figure 7:
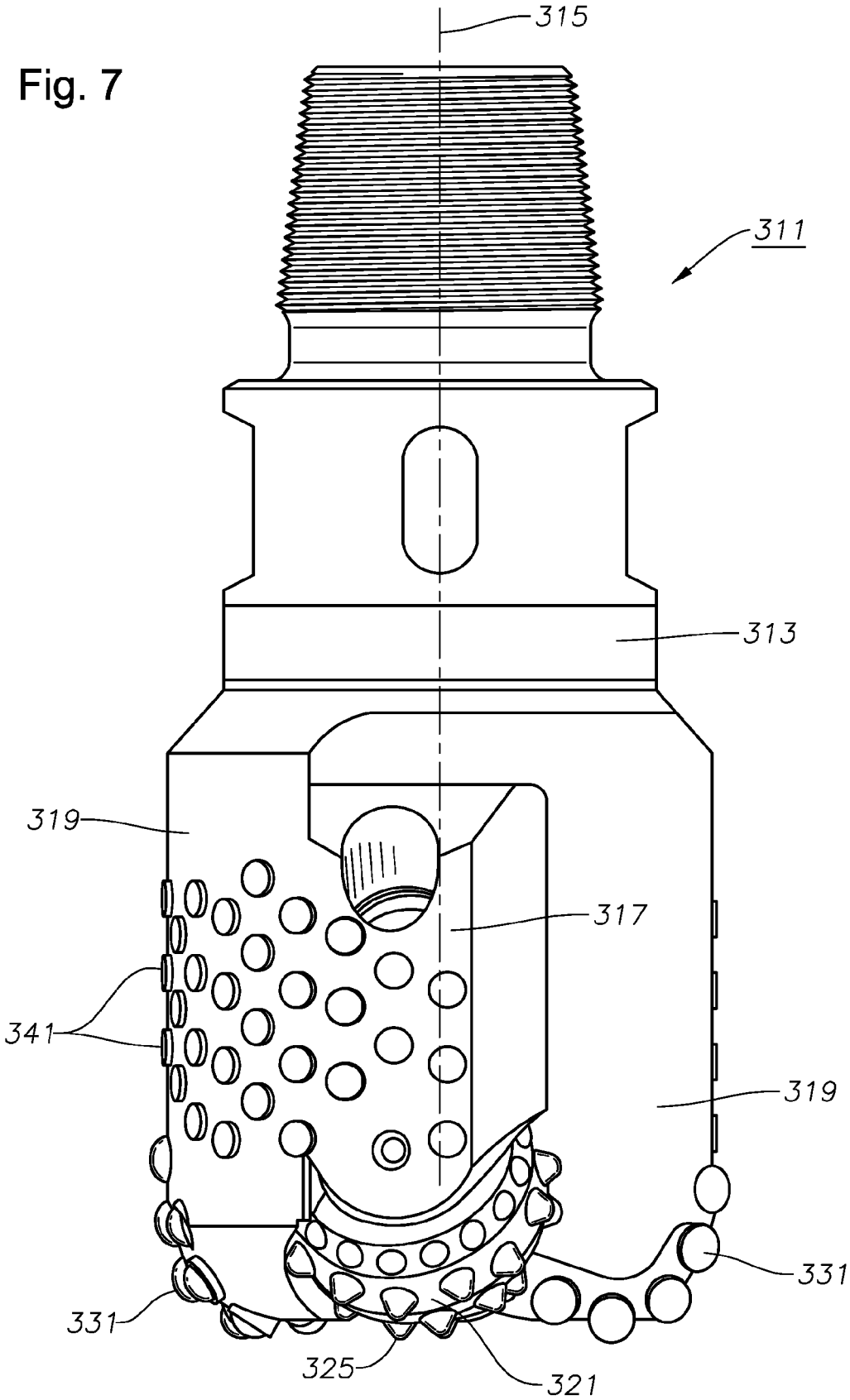
FIG. 7 is a side elevation view of another embodiment of the hybrid earth-boring bit constructed in accordance with the present invention.
Figure 8:
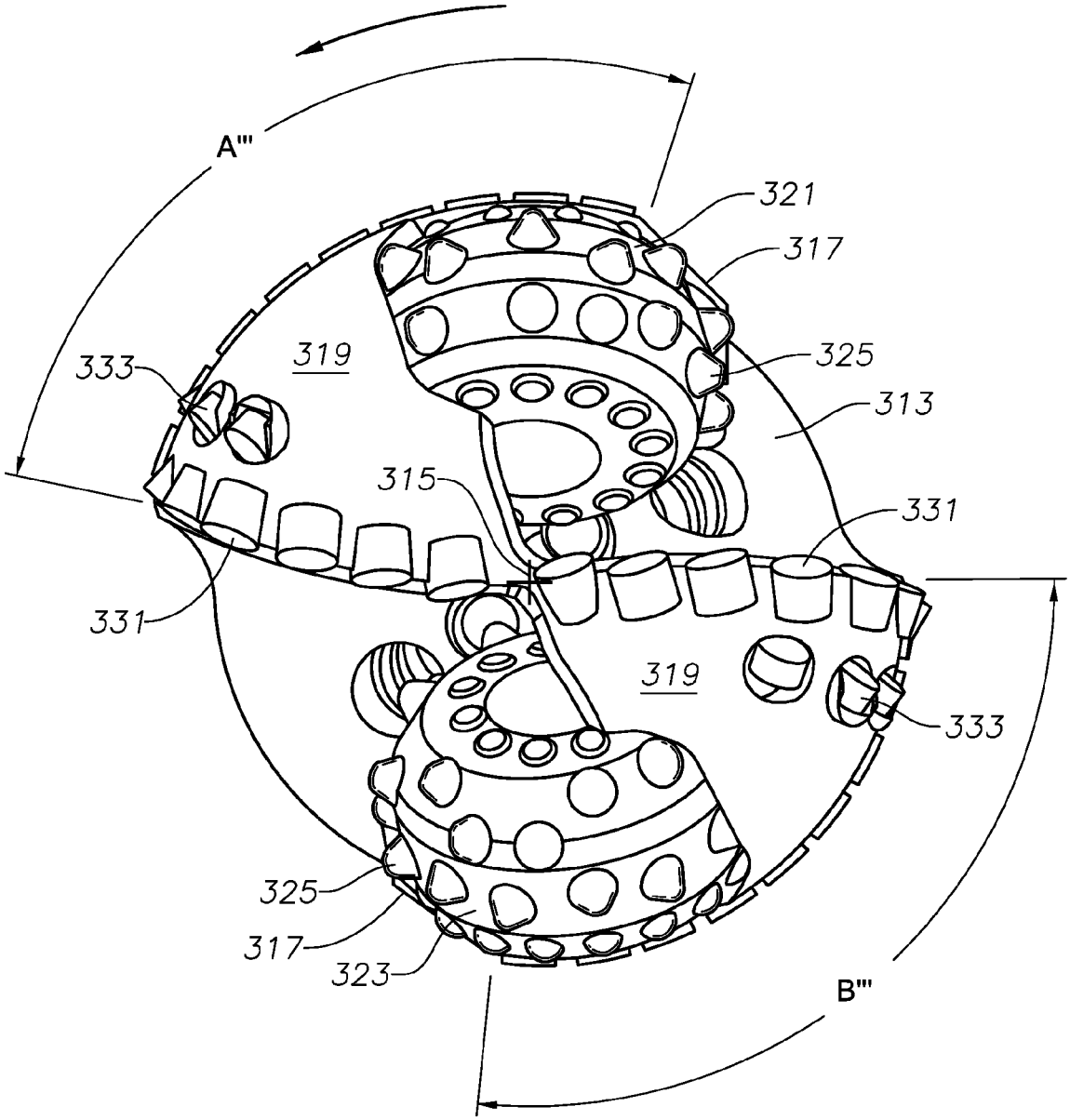
FIG. 8 is a bottom plan view of the embodiment of the hybrid earth-boring bit of FIG. 7 constructed in accordance with the present invention.

FIGS. 7 and 8 disclose another illustrative embodiment in which stabilization is achieved by merging the radially outermost portions of each bit leg (317) with the fixed blade that rotationally leads the leg (similar structures numbered similarly, e.g. bit legs 17, 317; blades 19, 319, etc.). As described, the radially outermost surfaces of bit legs 317 and fixed blades 319 are congruent at the gage diameter of the bit and are circumferentially joined or integrally formed so that there is no junk slot formed between the blade 319 and the bit leg 317 that rotationally trails it. This merged structure forms a stabilizer pad (not numbered). Although the terms "joined" or "merged" are used, they are intended to encompass any manufacturing process resulting in a single radially outermost surface for each blade 319 and the leg 317 that trails it, whether the process involves actually joining the structures or forming them integrally as a single unit. The illustrative embodiment shows two legs 317 (and associated cutters 321, 323) and two blades 319, but bits having more blades and more legs (and associated cutters). However, this embodiment is not as easily adapted to bits having uneven numbers of blades and bit legs (and associated cutters) as are the embodiments of FIGS. 1 through 6.

Each stabilizer pad 51, 151, 251 (and the portions of each bit leg 17, 217, 317 and fixed blade 19, 219, 319 that extend radially outwardly to the full gage diameter of the bit 11) describes a segment or angular portion (A, B, C, D, E, and F, in FIG. 2; A', B', C', and D' in FIG. 4; and A", B", C", and D" in FIG. 6) of the circumference of the borehole being drilled (shown in phantom in FIGS. 2 and 4). The size (and number) of pads preferably is selected so that the total segment or angular portion of the bit gage circumference equals or exceeds 180 degrees. This includes the segment or angular portion described by the gage or radially outermost portion of fixed blades 19, and by bit legs 17, if their gage or radially outermost portion extends to full gage diameter, but does not if these structures do not extend to full gage to act as stabilizer pads.

By way of example, the segments or angular portions described by various stabilizer pads 51, full-gage bit legs 17, and full-gage blades 19 in FIG. 2 are:

A=D=34°

B=E=36°

C=F=24°

The segments or angular portions described by full-gage bit legs 17 and blades 19 with integrated stabilizer pads 151 in FIG. 4 are:

A'=C'=34°

B'=D'=66°

The segments or angular portions described by full-gage bit legs 217 and blades 219 in FIG. 6 are:

A"=C"=34°

B"=D"=81°

In the case of the embodiment of FIGS. 7 and 8, where the stabilizer pad is formed by the joined or integrally formed fixed blades 319 and bit legs 317, the segments or angular portions described are:

A'"=B'"=96°

The invention has several advantages and includes providing a hybrid drill bit that is stable in drilling operation while avoiding off-center running. A stable-running bit avoids damage to cutting elements that could cause premature failure of the bit.

While the invention has been shown or described in only some of its forms, it should be apparent to those skilled in the art that it is not so limited, but is susceptible to various changes without departing from the scope of the invention as hereinafter claimed, and legal equivalents thereof.

We claim:

1. An earth-boring bit comprising:

a bit body having a central longitudinal axis that defines an axial center of the bit body and configured at its upper extent for connection into a drill string;

at least one fixed blade extending downwardly from the bit body, the fixed blade having a radially outermost gage surface that extends outward to substantially the full gage diameter of the bit;

a plurality of fixed cutting elements secured to the fixed blade, wherein at least a portion of at least one of the plurality of fixed cutting elements is located at or near the axial center of the bit body and has its laterally innermost edge tangent to the axial center;

at least one bit leg secured to the bit body;

a rolling cutter mounted for rotation on the bit leg; and at least one stabilizer pad disposed between the at least one bit leg and the at least one fixed blade, the stabilizer pad extending radially outward to substantially the gage surface.

2. The earth-boring bit according to claim 1, further comprising a plurality of rolling-cutter cutting elements arranged on the rolling cutter.

3. The earth-boring bit according to claim 1, wherein the stabilizer pad is formed integrally with the fixed blade and extends toward the bit leg.

4. The earth-boring bit according to claim 1, wherein at least a portion of the fixed cutting elements are arranged in a row on a rotationally leading edge of the fixed blade.

5. The earth-boring bit according to claim 1, wherein the stabilizer pad, gage surface of each fixed blade, and a portion of the bit leg extending to the gage surface together describe a segment of the circumference of the borehole that equals or exceeds 180 degrees.

6. The earth-boring bit according to claim 1, further comprising:

a plurality of fixed blades extending downwardly from the bit body;

a plurality of bit legs extending downwardly from the bit body; and a stabilizer pad located discretely and separately between each bit leg and each fixed blade, wherein the plurality of bit legs are not directly opposite one another, and the plurality of fixed blades are not directly opposite one another.

7. The earth-boring bit according to claim 1, wherein each stabilizer pad has an equal area exposed to the sidewall of the borehole being drilled.

8. An earth-boring bit comprising:

a bit body haying a central longitudinal axis that defines an axial center of the bit body and configured at its upper extent for connection into a drillstring;

a plurality of fixed blades extending downwardly from the bit body, each fixed blade having a radially outermost gage surface;

a plurality of fixed cutting elements secured to each fixed blade;

at least one bit leg secured to the bit body;

a rolling cutter mounted for rotation on the bit leg;

at least one rolling-cutter cutting element arranged on the rolling cutter; and at least one stabilizer pad disposed between at least one of the bit legs and at least one of the fixed blades, the stabilizer pad extending radially outward to substantially the gage surface of the bit, wherein the plurality of fixed blades are not directly opposite one another, and wherein a portion of the bit leg extends radially outward to substantially the gage surface and the stabilizer pad, gage surface of each fixed blade, and the portion of the bit leg extending to the gage surface together describe a segment of the circumference of the borehole that equals or exceeds 180 degrees.

9. The earth-boring bit according to claim 8, wherein the stabilizer pad is formed integrally with the fixed blade and extends toward one of the bit legs in a rotationally leading direction.

10. The earth-boring bit according to claim 8, wherein at least a portion of the fixed cutting elements are arranged in a row on a rotationally leading edge of the fixed blade.

11. The earth-boring bit according to claim 8, wherein each stabilizer pad has an equal area exposed to the sidewall of the borehole being drilled.

12. An earth-boring bit comprising:

a bit body configured at its upper extent for connection into a drillstring, the bit body haying a central longitudinal axis a plurality of fixed blades depending from the bit body wherein the fixed blades are not directly opposite one another, each fixed blade having a radially outermost gage surface that defines a gage diameter of the bit and of the borehole being drilled;

a plurality of fixed cutting elements secured to a rotationally leading edge of each fixed blade;

a plurality of bit legs depending from the bit body, wherein the plurality of bit legs are not directly opposite one another;

a rolling cutter mounted for rotation on each bit leg;

a plurality of rolling-cutter cutting elements arranged on each rolling cutter; and at least one discrete stabilizer pad disposed between each bit leg and each fixed blade, the stabilizer pad extending radially outward to substantially the gage surface.

13. The earth-boring bit according to claim 12, wherein the stabilizer pad is formed integrally with the fixed blade and extends toward one of the bit legs in a rotationally leading direction.

14. The earth-boring bit according to claim 12, wherein each stabilizer pad has an equal area exposed to the sidewall of the borehole being drilled.

15. The earth-boring bit according to claim 12, wherein a portion of the bit leg extends radially outward to substantially the gage surface and the stabilizer pad, gage surface of each fixed blade, and the portion of the bit leg extending to the gage surface together describe a segment of the circumference of the borehole that equals or exceeds 180 degrees.

16. An earth-boring bit comprising:

a bit body configured at its upper extent for connection into a drillstring, the bit body having a central longitudinal axis;

at least one fixed blade extending downwardly from the bit body, the fixed blade having a radially outermost gage surface, the gage surface of each fixed blade extending axially downward at an angle other than zero relative to the longitudinal axis of the bit body;

a plurality of fixed cutting elements secured to each fixed blade, wherein at least a portion of at least one of the plurality of fixed cutting elements is located at or near the axial center of the bit body and has its laterally innermost edge tangent to the axial center;

at least one bit leg secured to the bit body;

a rolling cutter mounted for rotation on the bit leg; and at least one rolling-cutter cutting element arranged on the rolling cutter, wherein the gage surface of the at least one fixed blade has a leading edge and a trailing edge, the gage surface of the at least one fixed blade acting as a stabilization pad, and wherein the at least one fixed blade operates as a stabilizer pad.

17. The earth-boring bit according to claim 16 wherein the gage at least one of the leading and trailing edge extends axially downward at an angle other than zero relative to the longitudinal axis of the bit body.

18. The earth-boring bit according to claim 16, further comprising:

a plurality of fixed blades extending downwardly from the bit body at an angle other than zero relative to the longitudinal axis of the bit body, wherein the fixed blades are not directly opposite one another; and a plurality of bit legs extending downwardly from the bit body, a portion of each bit leg extending radially outward to substantially the gage surface, wherein the bit legs are not directly opposite one another.

19. The earth-boring bit according to claim 17, wherein the leading and trailing edges are linear.

20. The earth-boring bit according to claim 17, wherein the leading and trailing edges are curved and define a helix about the longitudinal axis.

21. The earth-boring bit according to claim 16, further comprising a stabilizer pad disposed between the at least one bit leg and the at least one fixed blade, the stabilizer pad extending radially outward to substantially the gage surface.

22. An earth-boring bit comprising:

a bit body configured at its upper extent for connection into a drillstring, the bit body having a central longitudinal axis;

at least one fixed blade extending downwardly from the bit body, the fixed blade having a radially outermost gage surface, the gage surface of each fixed blade extending axially downward and non-parallel to the longitudinal axis of the bit body;

a plurality of fixed cutting elements secured to each fixed blade; at least one bit leg secured to the bit body;

a rolling cutter mounted for rotation on the bit leg; and at least one rolling-cutter cutting element arranged on the rolling cutter, wherein the at least one fixed blade operates as a stabilizer pad, and wherein the chordal drop between the leading edge of the at least one fixed blade and the trailing edge of the at least one bit leg is substantially equal.

23. The earth-boring bit according to claim 22 wherein the gage surface of the fixed blade has a leading edge and a trailing edge, and at least one of the leading and trailing edge extends axially downward non-parallel to the longitudinal axis of the bit body.

24. The earth-boring bit according to claim 22, further comprising:

a plurality of fixed blades extending downwardly from the bit body non-parallel to the longitudinal axis of the bit body, wherein the fixed blades are not directly opposite one another; and a plurality of bit legs extending downwardly from the bit body, a portion of each bit leg extending radially outward to substantially the gage surface, wherein the bit legs are not directly opposite one another.

25. The earth-boring bit according to claim 23, wherein the leading and trailing edges are linear.

26. The earth-boring bit according to claim 23, wherein the leading and trailing edges are curved and define a helix about the longitudinal axis.

27. The earth-boring bit according to claim 22, further comprising a stabilizer pad disposed between the at least one bit leg and the at least one fixed blade, the stabilizer pad extending radially outward to substantially the gage surface.

* * * * *